United States Patent [19]

Pryba

[11] Patent Number: 5,038,726

[45] Date of Patent: Aug. 13, 1991

[54] ROCKER ARM WITH INTEGRAL BALL PIVOT SOCKET

[75] Inventor: Stanley J. Pryba, Toledo, Ohio

[73] Assignee: Henley Manufacturing Holding Company, Inc., Hampton, N.H.

[21] Appl. No.: 574,735

[22] Filed: Aug. 30, 1990

[51] Int. Cl.[5] ..... F01L 1/18

[52] U.S. Cl. ..... 123/90.41; 123/90.39

[58] Field of Search ..... 123/90.39, 90.4, 90.41, 123/90.42, 90.44, 90.45, 90.47, 90.33, 90.36; 74/519, 559

[56] References Cited

U.S. PATENT DOCUMENTS

| | | | |
|---|---|---|---|
| 1,699,657 | 1/1929 | Fagan | 123/90.39 |
| 2,905,161 | 9/1959 | Latham | 123/90.36 |
| 3,418,985 | 12/1968 | Hirose | 123/90.39 |
| 3,855,981 | 12/1974 | Loon | 123/90.36 |
| 4,430,783 | 2/1984 | Wherry | 123/90.39 |
| 4,724,803 | 2/1988 | Williams | 123/90.39 |
| 4,763,616 | 8/1988 | Grinsteiner | 123/90.41 |
| 4,856,466 | 8/1989 | Ting et al. | 123/90.33 |
| 4,934,323 | 6/1990 | Grinsteiner | 123/90.41 |

FOREIGN PATENT DOCUMENTS

| | | | |
|---|---|---|---|
| 2193997 | 2/1988 | United Kingdom | 123/90.39 |

*Primary Examiner*—David A. Okonsky
*Assistant Examiner*—Weilun Lo
*Attorney, Agent, or Firm*—Allen D. Gutchess, Jr.

[57] ABSTRACT

A rocker arm for an internal combustion engine is disclosed. The rocker arm has a cold-formed, one-piece metal body with a narrow width and a substantial depth. The body has a pad at one end for engaging an end of a valve stem and has a socket at the other end for engaging the upper end of a push rod. An intermediate portion of the body has a large opening of generally trapezoidal configuration with a lower edge longer than an upper edge. A middle portion of the lower edge has a structurally-integral, outwardly-flared portion defining an upwardly-facing socket for engaging a pivot ball about which the rocker arm can pivot during operation.

16 Claims, 2 Drawing Sheets

ROCKER ARM WITH INTEGRAL BALL PIVOT SOCKET

This invention relates to a rocker arm with a structurally-integral, upwardly-facing socket at an intermediate portion thereof for engaging a pivot ball about which the rocker arm pivots.

Rocker arms which pivot about pivot balls and have means at one end for engaging and operating a valve of an internal combustion engine when pivoted by a push rod engaged with the other end of the rocker arm are known in the art, as shown in U.S. Pat. No. 4,763,616, issued June 23, 1987. That rocker arm has a separate part which is located in an intermediate opening in the rocker arm and straddles a lower edge of the opening. The part forms a socket which receives a ball bearing about which the rocker arm pivots.

The rocker arm in accordance with the invention has a cold-formed, one-piece metal body with a large intermediate opening therein. The opening is of trapezoidal configuration with a lower edge which is longer than an upper edge. The one-piece body has a structurally-integral, outwardly-flared portion at an intermediate portion of the lower edge of the opening, which flared portion defines an upwardly-facing socket for engaging a pivot ball. The structurally-integral socket is formed on the rocker arm body by cold-forming, specifically stamping operations. There is no need for assembling separate parts for the sockets and there is no possibility that the sockets will come loose or be assembled incorrectly or not assembled at all with the rocker arms.

It is, therefore, a principal object of the invention to provide a rocker arm with a structurally-integral socket having the advantages set forth above.

Many other objects and advantages of the invention will be apparent from the following detailed description of a preferred embodiment thereof, reference being made to the accompanying drawings, in which.

Figure 1:
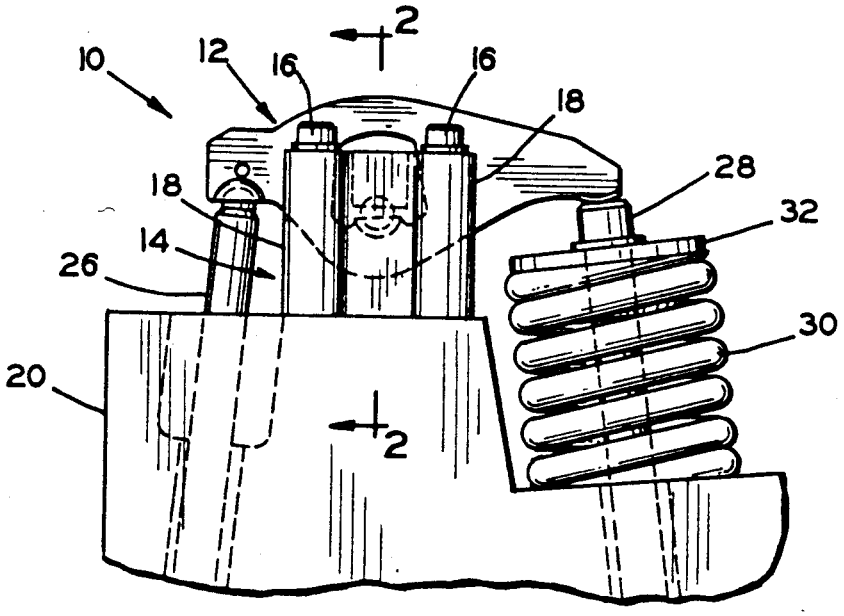
FIG. 1 is a side view in elevation of a rocker arm assembly in accordance with the invention and a portion of an internal combustion engine upon which it is mounted.
Figure 2:
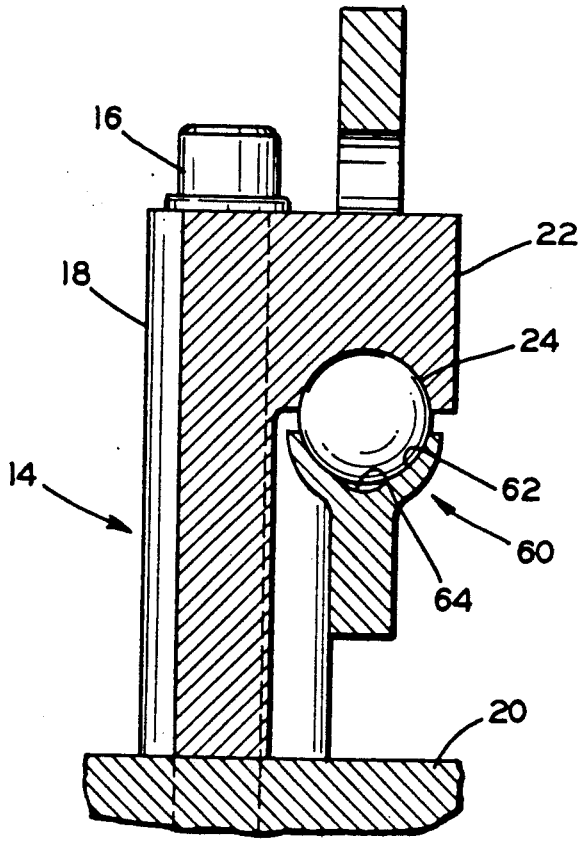
FIG. 2 is a greatly enlarged view in transverse cross section, taken along the line 2—2 of FIG. 1.
Figure 3:
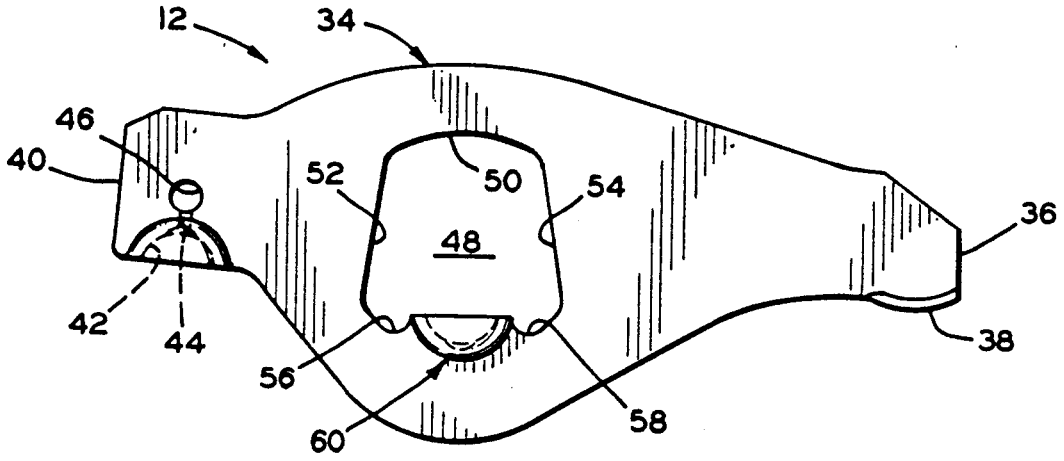
FIG. 3 is a side view in elevation of the rocker arm.
Figure 4:
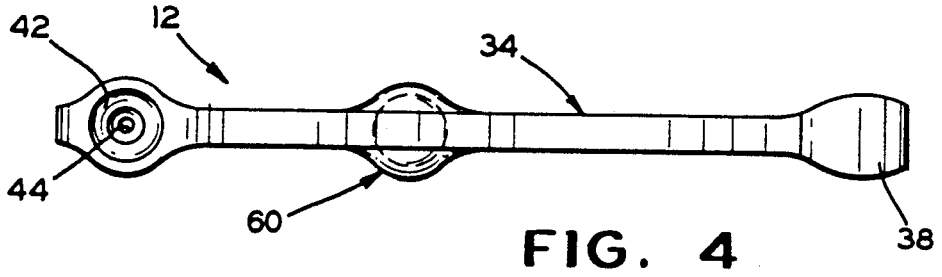
FIG. 4 is a bottom view of the rocker arm.

Referring to the drawings, and more particularly to FIG. 1, a rocker arm assembly in accordance with the invention is indicated at 10 and includes a cold-formed, one-piece metal rocker arm 12 which is pivotally supported by a supporting pedestal or post 14. Two machine bolts or other suitable threaded fasteners 16 extend through enlarged end portions 18 of the post and mount it on a cylinder head 20 of an engine block. The post also has an enlarged bearing support 22 which receives a pivot ball 24.

One end of the rocker arm 12 engages the upper end of a push rod 26 and the other end engages the upper end of a valve stem 28. The valve stem extends upwardly from a valve (not shown) in the cylinder head and through a coiled compression spring 30 located between the cylinder head 20 and a retaining ring 32 which is mounted on the valve stem.

Referring to FIGS. 3-6, the rocker arm 12 includes a one-piece metal body 34 which is made from a single, thick metal plate. One end portion 36 of the rocker arm body 34 has means 38 in the form of a pad with a convex surface facing downwardly to engage the valve stem 28. Another end portion 40 of the rocker arm body has means in the form of a generally semispherical, downwardly facing recess 42 which fits over the upper end of the push rod 26 and receives oil through a passage in the push rod. A tapered oil passage 44 and an opening 46 communicate with the recess 42 to receive and distribute oil.

The rocker arm 34 has a large central opening 48 therein in a generally trapezoidal shape. It includes a rounded upper edge 50, straight side edges 52 and 54 which converge in an upward direction, and rounded bottom edge portions 56 and 58. The rounded upper edge 50 is substantially parallel to the upper rounded edge of the rocker arm body 34 located above the opening 48. A structurally-integral, upwardly-facing pivot ball socket 60 is formed in the rocker arm body 34 between the lower edge portions 56 and 58 and has a generally semispherical recess 62 with a further central recessed area 64 of generally semispherical shape. The recessed area 64, of shorter radius than the recess 62, helps to assure that the pivot ball 24 will fit fully with the recess 62 and can provide a pocket for lubricant. The socket 60 is formed directly from the metal body 34 between the lower edge portions 56 and 58 of the opening 48. As such, no assembly operation is required to assemble the socket with the body and the socket cannot be incorrectly assembled or not assembled at all, as could otherwise occur. Further, there is no possibility that the socket will come loose during operation.

Figure 5:
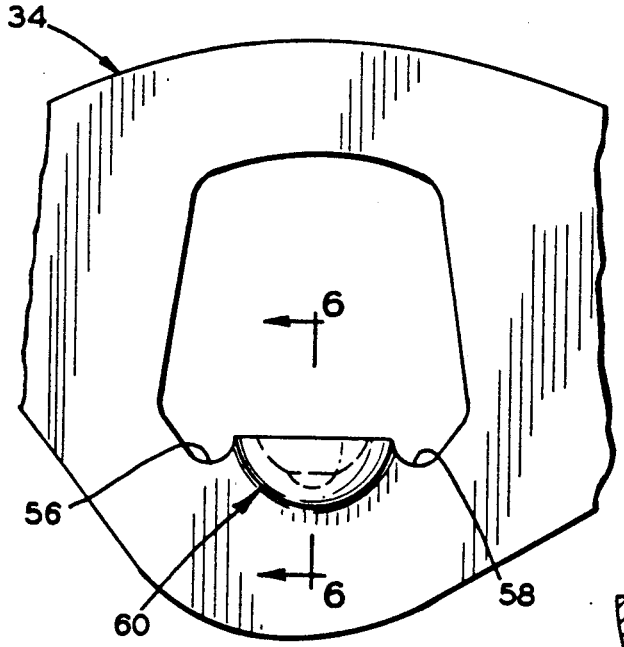
FIG. 5 is an enlarged fragmentary view in elevation of the rocker arm.
Figure 6:
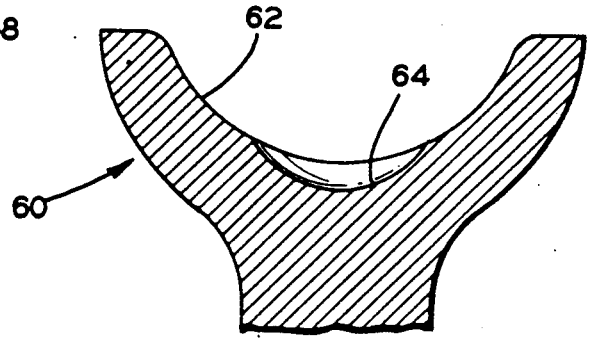
FIG. 6 is a further enlarged view in cross section, taken along the line 6—6 of FIG. 5.

As shown in FIG. 5, the socket 60 blends smoothly with the lower edge portions 56 and 58 through fillets and with the side surfaces of the body 34 by smooth curved surfaces (FIG. 6). Thus, there are no sharp or abrupt changes in these surfaces which could cause stress areas and possible cracks at a later time during operation.

The socket 60 is spaced from the side edges 52 and 54 of the opening 48 by a distance which is approximately one-half of the outer diameter of the socket 60. This distance can be from one-quarter to three-quarters of the diameter. The rocker arm is heat treated after being cold-formed and if the spacing is not maintained between the socket and the side edges 52 and 54 of the opening 48, distortion of the socket can result. The opening 48 is narrower at the top to reduce the overall size of the opening and the amount of metal which is removed from the rocker arm body 34.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A rocker arm for an internal combustion engine and adapted for operation by a push rod to operate a valve, said rocker arm comprising a cold-formed, one-piece metal body having a narrow width and a substantial depth, said body having means at one end for engaging a push rod and having means at the other end for engaging a valve stem of the valve, an intermediate portion of said body having a large opening defined, in part, by side edges and a lower edge, and an intermediate portion of said lower edge having a structurally-integral, outwardly-flared portion defining an upwardly-facing socket for engaging a pivot ball, said socket being spaced from said side edges by fillets.

2. A rocker arm according to claim 1 wherein said opening is of generally trapezoidal-shaped configuration with the lower edge longer than an upper edge.

3. A rocker arm according to claim 1 wherein said opening has said side edges converging in an upward direction.

4. A rocker arm according to claim 1 wherein an outer peripheral edge of said socket is spaced from said side edges a distance from one-quarter to three-quarters of an outer diameter of said socket.

5. A rocker arm according to claim 1 wherein an outer peripheral edge of said socket is spaced from said side edges a distance of approximately one-half of an outer diameter of said socket.

6. A rocker arm according to claim 1 wherein an upper edge of said opening is rounded and substantially parallel to an upper rounded edge of said rocker arm body located above said opening.

7. A rocker arm according to claim 1 wherein said upwardly-facing socket is of generally semispherical shape.

8. A rocker arm according to claim 7 wherein said socket has a central recessed area.

9. A rocker arm according to claim 8 wherein said recessed area is of generally semispherical shape and of a radius which is shorter than the radius of said socket.

10. A rocker arm for an internal combustion engine, said rocker arm comprising a cold-formed, one-piece metal body having means at one end for engaging a push rod and having means at the other end for engaging a valve stem of a valve, an intermediate portion of said body having a large opening defined, in part, by a lower edge, an upper edge which is shorter than the lower edge, and straight side edges converging in an upwardly direction, an intermediate portion of said lower edge having a structurally-integral, outwardly-flared portion defining an upwardly-facing socket for engaging a pivot ball about which said rocker arm can pivot, an upper annular edge of said socket being above said lower edge of said opening, said lower edge sloping downwardly from opposite sides of said annular edge and then curving upwardly to said side edges.

11. A rocker arm according to claim 10 wherein said opening is of generally trapezoidal-shaped configuration with the lower edge longer that the upper edge.

12. A rocker arm according to claim 10 wherein an outer peripheral edge of said socket is spaced from said side edges a distance from one-quarter to three-quarters of an outer diameter of said socket.

13. A rocker arm according to claim 10 wherein an outer peripheral edge of said socket is spaced from said side edges a distance of approximately one-half of an outer diameter of said socket.

14. A rocker arm according to claim 10 wherein an upper edge of said opening is rounded and substantially parallel to an upper rounded edge of said rocker arm body located above said opening.

15. A rocker arm according to claim 10 wherein said upwardly-facing socket is of generally semispherical shape.

16. A rocker arm according to claim wherein said socket has a central recessed area.

* * * * *

UNITED STATES PATENT AND TRADEMARK OFFICE

CERTIFICATE OF CORRECTION

PATENT NO. : 5,038,726

DATED : August 13, 1991

INVENTOR(S) : Stanley J. Pryba

It is certified that error appears in the above-identified patent and that said Letters Patent is hereby corrected as shown below:

Column 4, line 15, claim 11, line 3, change "that" to --than--.

Column 4, line 31, claim 16, line 1, after "claim" insert --15--

Signed and Sealed this

Eighth Day of December, 1992

*Attest:*

DOUGLAS B. COMER

*Attesting Officer*

*Acting Commissioner of Patents and Trademarks*